United States Patent [19]

Scalera

[11] 4,340,268

[45] Jul. 20, 1982

[54] SNEAK CURRENT PROTECTOR MODULE

[75] Inventor: Michael Scalera, Randolph, N.J.

[73] Assignee: Bell Telephone Laboratories, Incorporated, Murray Hill, N.J.

[21] Appl. No.: 164,601

[22] Filed: Jun. 30, 1980

[51] Int. Cl.[3] ..... H01R 25/00

[52] U.S. Cl. ..... 339/18 R; 339/147 R; 339/97 P

[58] Field of Search ..... 339/18 R, 18 C, 198 R, 339/147 R, 97 P

[56] References Cited

U.S. PATENT DOCUMENTS

| | | | |
|---|---|---|---|
| 3,112,147 | 11/1963 | Pferd et al. | 339/97 |
| 3,760,328 | 9/1973 | Georgopulos | 339/198 R X |
| 3,936,133 | 2/1976 | Splitt et al. | 339/18 R X |
| 4,057,843 | 11/1977 | Saligny | 339/18 C X |

*Primary Examiner*—John McQuade
*Assistant Examiner*—Frank H. McKenzie, Jr.
*Attorney, Agent, or Firm*—J. W. Fisher

[57] ABSTRACT

A sneak current protector module (10) is disclosed. This module is comprised of an insulative base (11), slotted beam electrical contact pairs (31), fuse elements (51) and fuse mounting members (71). The insulative base includes a plurality of apertures (13) for holding the contact pairs. Slidably affixed to oppositely disposed edges of the insulative base are the fuse mounting members. These mounting members contain a plurality of well-like cavities (73), for holding the fuse elements. Opposite ends (55,56) of the fuse elements are electrically coupled to electrically isolated contacts (33) in different ones of the contact pairs.

11 Claims, 3 Drawing Figures

10
11
12
13
20
21
22
23
24
31
32
33
34
51
52
53
55
56
71
72
73
74
75
76
77
78
80
81

SNEAK CURRENT PROTECTOR MODULE

BACKGROUND OF THE INVENTION

1. Technical Field of the Invention

This invention relates to electrical connectors and, in particular, to a circuit selecting panel-type cross-connector which provides protection against sneak currents.

2. Description of the Prior Art

In numerous telecommunications equipment installations, cross-connectors are used to rapidly and reliably interconnect various circuits. One form of cross-connector that has been used in these applications is disclosed in W. Pferd et al., U.S. Pat. No. 3,112,147 issued Nov. 26, 1963. The Pferd et al connector is comprised of an insulative block having a plurality of channels therein for receiving linear arrays of insulation crushing solid wire clip terminals. Integral with one edge of the insulative block is a fanning strip used to route wires in an orderly fashion to individual terminals in the connector. While this connector has been found to be extremely satisfactory in many applications, by itself it is not directly useful in telecommunications applications wherein certain forms of protection are required.

In those applications requiring protection, the phenomena sought to be protected against typically is either excessive voltages and currents or sneak currents. For excessive voltages and currents one form of protection device is similar to that disclosed in T. Georgopulos, U.S. Pat. No. 3,760,328 issued Sept. 18, 1973. Georgopulos relates to an electrical connector body for use with a telephone central office main distributing frame. This connector body includes a generally elongated flat rectangular panel and a plurality of socket-type apertures in the panel face in which to mount pluggable circuit protector modules. These socket-type apertures are disposed intermediately of a central first set of pin terminals and first and second longitudinal edge sets of pin terminals. The apertures are geometrically arranged with respect to each other and with respect to the sets of pin terminals so as to provide a readily ascertainable geometrical pattern of association between selected ones of the sets of pin terminals and a selected aperture.

While the Georgopulos connector is suitable for providing protection against excessive voltages and currents, it is not suitable for providing protection against sneak currents. Furthermore, the Georgopulos connector has little utility for applications which require rapid and reliable cross connection capability.

One technique that has been employed to reduce the effects of sneak currents is to couple a fuse element in series with the tip and ring conductors of the telecommunication circuit. While this approach is relatively straightforward from an electrical point of view, the implementation of this form of protection from a mechanical point of view has been somewhat expensive in both cost of materials and space. For example, in order to couple fuse elements into the tip and ring circuits of PBX lines, the circuits are first coupled to a separate connector block holding the fuse elements. This connector block then has to be physically interconnected by individual jumper wires to a cross-connection terminal block.

In view of the foregoing, it is evident that the problem has been and continues to be the provision of a cross-connection terminal block with protection against sneak currents.

SUMMARY OF THE INVENTION

The problem, as described above, is overcome in accordance with my invention of a sneak current protector module. An illustrative embodiment of my sneak current protector module is comprised of an insulative base having a plurality of apertures therein. A plurality of slotted beam electrical contact pairs are mounted in the plurality of apertures in the base. The module further includes a plurality of fuse elements. Each of the fuse elements has means at opposite ends for effecting an electrical connection to electrically isolated contacts in different ones of the contact pairs. The sneak current protector module further includes means, slidably affixed to the insulative base, for mounting the plurality of fuse elements along an edge of the base.

One advantage of my invention is the inclusion of a wire fanning capability along an inner edge of the fuse element mounting means such that the electrical conductors coupling the fuse element ends to the slotted beam contacts can be advantageously routed thereto in an orderly fashion.

Another advantage of my invention resides in the inclusion of a similar wire fanning capability along an outer edge of the fuse element mounting means in order to facilitate the routing of the tip and ring conductors to the slotted beam contacts.

BRIEF DESCRIPTION OF THE DRAWINGS

The aforementioned advantages of my invention, as well as other advantages, will be better understood upon a consideration of the following detailed description and the appended claims taken in conjunction with the attached drawings of an illustrative embodiment in which:

DETAILED DESCRIPTION

Figures 1, 2:
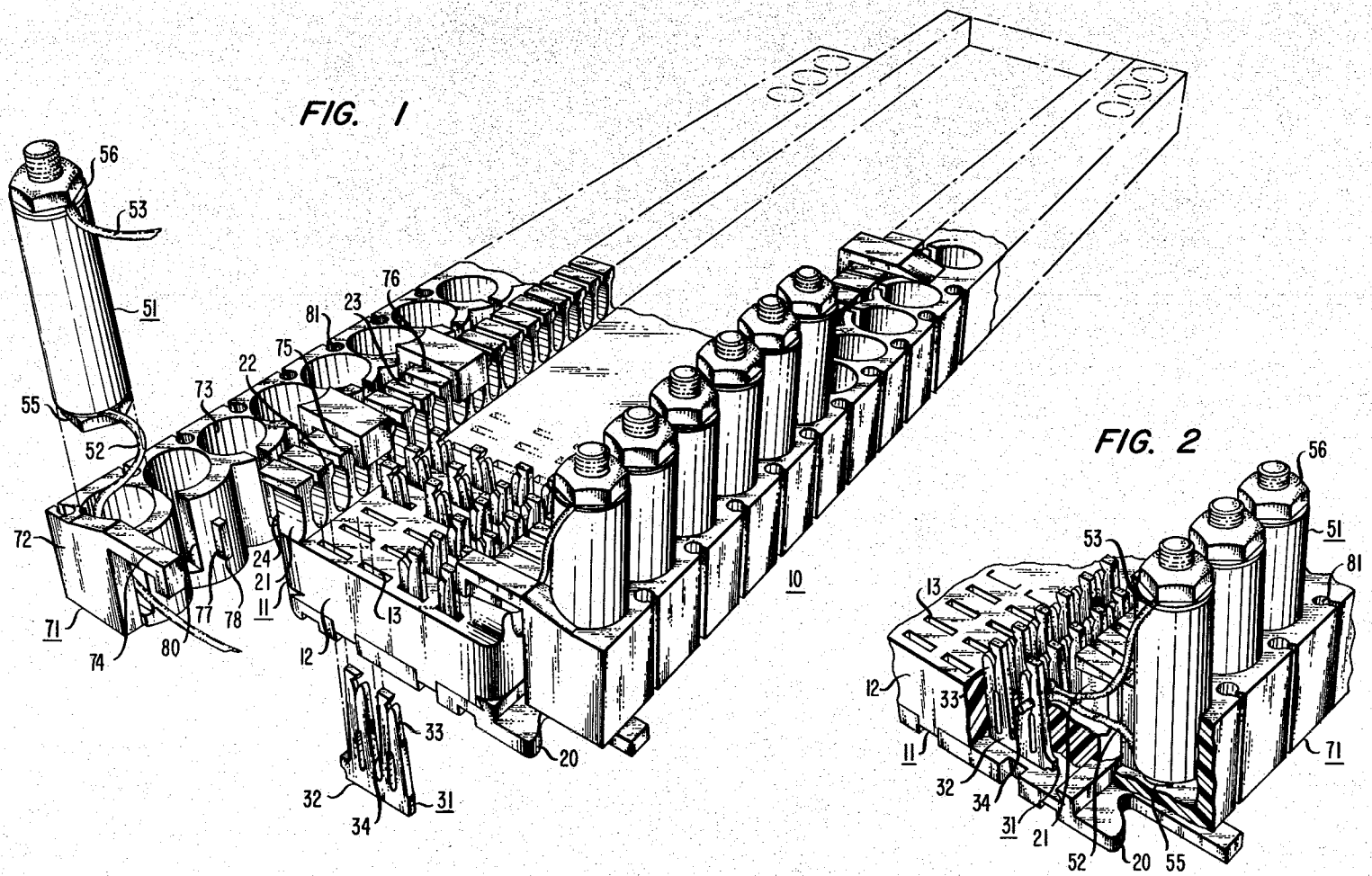
FIG. 1 is a partially exploded top perspective view of a sneak current protector module illustrating the mounting of fuse elements along a fanning strip integral with a cross-connector block.
FIG. 2 is a partial perspective view of the sneak current protector module illustrating the routing of the fuse element coupling conductors to electrically isolated contacts in different ones of slotted beam contact pairs, such conductor routing being facilitated by wire fanning capability included in the fuse element mounting means.

A sneak current protector module 10 is illustrated in the partially exploded top perspective view of FIG. 1. Protector module 10 is comprised of insulative base 11, slotted beam electrical contact pairs 31, fuse elements 51 and fuse mounting members 71.

Figure 3:
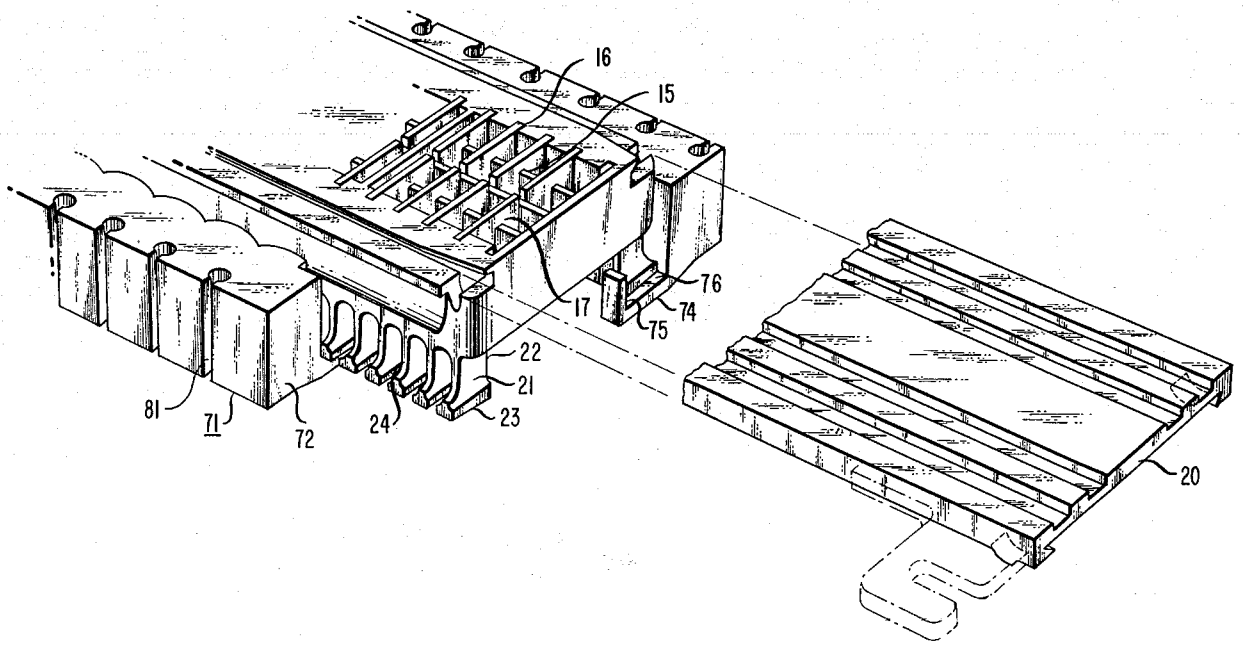
FIG. 3 is a partially exploded bottom perspective view of the sneak current protector module illustrating further the mechanical coupling between the cross-connector block and the fuse element mounting means.

Insulative base 11 includes a generally rectangular support member 12 which has a plurality of rectangular apertures 13 therein. Apertures 13 are formed in support member 12, as shown in FIG. 3, by a plurality of longitudinally extending webs 15 and a plurality of laterally extending webs 16. Webs 15 and 16, which intersect at right angles, are so positioned depthwise that webs 16 generally extend to a greater depth than webs 15 when viewed from the bottom surface of support member 12. Along the tops of webs 15 at regular intervals are notches 17. The function of notches 17 will become apparent shortly.

Slotted beam electrical contact pairs 31, which are shown in FIGS. 1 and 2, are comprised of a base support strip 32 with a pair of bifurcated, insulation abrading or piercing contacts 33 extending therefrom. Contacts 33 are so positioned with respect to one another that a trough 34 is formed between them. Troughs 34, when contact pairs 31 are inserted into apertures 13, engage notches 17 to hold contact pairs 31 fixedly positioned in support member 12. Contact pairs 31 are retained in support member 12 by slidable cover 20, as shown in FIGS. 2 and 3.

Integrally formed along the edges of support member 12, as shown in FIG. 1, are wire fanning strips 21. Slidably affixed to fanning strips 21 are fuse mounting members 71, which are fabricated of electrically insulative material. Each of fuse mounting members 71 is comprised of a generally elongated member 72 which has a linear array of well-like cavities 73 therein. Cavities 73 are used to hold fuse elements 51 in proper alignment for electrical connection to contact pairs 31, which connection will be more fully described subsequently.

Along the top of elongated member 72 are a plurality of integrally formed generally L-shaped, hooklike members 74. Hooklike members 74 are spaced-apart from one another and positioned periodically throughout the length of elongated member 72. Each of hooklike members 74 extends laterally from the same side of elongated member 72. Hooklike members 74 have first and second surfaces 75 and 76 which engage inner surface 22 and top surface 23, respectively, of wire fanning strip 21 along the edge of support member 12. By virtue of this interaction, elongated member 72 is held juxtaposed fanning strip 21 to facilitate electrical connection of fuse elements 51 to contact pairs 31. It should be noted that first surface 75 lies in a first plane which is parallel with a second plane containing axes of well-like cavities 73. Moreover, second surface 76 lies in a third plane which is generally perpendicular to the first and second planes heretofore defined.

In addition to hooklike members 74 being integrally formed along the top of elongated member 72, this latter element has integrally formed with side surfaces of a number of cavities 73 generally rectangular-shaped tabs 77. Each of tabs 77 extends laterally from elongated member 72 in the same direction as hooklike members 74. Surface 78 on tab 77 is adapted for engagement with outer surface 24 of wire fanning strip 21 so as to maintain elongated member 72 in a planar relationship with insulative base 11.

The heretofore described configuration of fuse mounting member 71 facilitates its being slidably affixed to insulative base 11. Once fuse mounting member 71 is in place, fuse elements 51 can be inserted into cavities 73 and electrically coupled to contact pairs 31. To aid in the routing of wires 52 and 53 to and from fuse element 51, two additional aspects of fuse mounting member 71 remain to be considered.

One of these additional aspects relates to slots 80 which extend from a top edge of a cavity 73 to a point adjacent to a bottom inner surface thereof. Slots 80 provide an access way for wire 52 which is used to couple first end 55 of fuse element 51 to one of the two contacts 33 in contact pair 31. Accordingly, there is one slot 80 formed in each of cavities 73. It should be noted that second end 56 of fuse element 51 is coupled by wire 53 to an electrically isolated contact 33 in a different one of contact pairs 31 from that used to terminate wire 52.

The second additional aspect relates to wire fanning slots 81 which extend transversely of elongated member 72. Wire fanning slots 81 are positioned such that a plane of symmetry of a slot also contains the point of juncture of two adjacent cavities 73. These wire fanning slots 81 serve to route electrical conductors to and from the remaining unused contacts 33 in the contact pairs 31 used to terminate fuse element 51.

In all cases it is to be understood that the above-identified embodiment is illustrative of but a small number of many possible specific embodiments which can represent applications of the principles of the invention. Thus, numerous and various other embodiments can be devised readily in accordance with these principles by those skilled in the art without departing from the spirit and scope of the invention.

I claim:

1. A sneak current protector module (10) comprising:

an insulative base (11) having a plurality of apertures (13) therein;

a plurality of slotted beam electrical contact pairs (31) mounted in said plurality of apertures in said base;

a plurality of fuse elements (51), each of said fuse elements having means (52,53) at opposite ends (55,56) thereof for effecting an electrical connection to electrically isolated contacts (33) in different ones of said contact pairs; characterized in that said sneak current protector module further includes means (71), slidably affixed to said insulative base, for mounting said plurality of fuse elements along an edge (21) of said base.

2. The sneak current protector module (10) in accordance with claim 1 wherein said mounting means (71) comprises:

a generally elongated member (72) having a linear array of well-like cavities (73) therein, said cavities being used to hold said fuse elements (51);

means (74,75,76), integrally formed with a top surface of said elongated member, for engaging an inner surface (22) and a top surface (23) of said edge (21) of said base (11) so that said elongated member is held juxtaposed said edge of said base; and means (77,78), integrally formed with a side surface of said elongated member, for maintaining said elongated member in a planar relationship with said base.

3. The sneak current protector module (10) in accordance with claim 2 wherein said engaging means (74,75,76) comprises:

a plurality of spaced-apart, generally L-shaped, hooklike members (74) extending laterally from said elongated member (72), each of said hooklike members having a first surface (75) which lies in a first plane parallel with a second plane containing axes of said well-like cavities (73) and further having a second surface (76) which lies in a third plane generally perpendicular to said first and second planes, said first surface adapted for engagement with said inner surface (22) of said edge (21) of said base (11) and said second surface adapted for engagement with said top surface (23) of said edge of said base.

4. The sneak current protector module (10) in accordance with claim 3 wherein said maintaining means (77,78) comprises:

a plurality of spaced-apart, generally rectangular-shaped tabs (77) each of which extends laterally from said elongated member (72) in the same direction as said hooklike members (74), each of said tabs having a surface (78) which is adapted for engagement with an outer surface (24) of said edge (21) of said base (11).

5. The sneak current protector module (10) in accordance with claim 1 wherein said mounting means (71) comprises:

a generally elongated member (72) having a linear array of well-like cavities (73) therein, said cavities being used to hold said fuse elements (51);

a plurlity of spaced-apart, generally L-shaped, hook-like members (74) extending laterally from said elongated member, each of said hooklike members having a first surface (75) which lies in a first plane parallel with a second plane containing axes of said well-like cavities and further having a second surface (76) which lies in a third plane generally perpendicular to said first and second planes, said first surface adapted for engagement with an inner surface (22) of said edge (21) of said base (11) and said second surface adapted for engagement with a top surface (23) of said edge of said base; and a plurality of spaced-apart, generally rectangular-shaped tabs (77) each of which extends laterally from said elongated member in the same direction as said hooklike members, each of said tabs having a surface (78) which is adapted for engagement with an outer surface (24) of said edge of said base, said tabs maintaining said elongated member in a planar relationship with said base.

6. The sneak current protector module (10) in accordance with claim 5 wherein said elongated member (72) further includes:

a plurality of slots (80), one such slot for each of said well-like cavities (73) each of said slots extending from a top edge of a cavity to a point adjacent to a bottom inner surface of said cavity, said slots providing an access way for an electrical conductor (52) coupling one end (55) of a fuse element (51) to a first one of said contacts (33) in a contact pair (31).

7. The sneak current protector module (10) in accordance with claim 5 wherein said elongated member (72) further includes:

a plurality of wire fanning slots (81), one such slot for each of said well-like cavities (73), each of said slots extending transversely of said elongated member and positioned such that a plane of symmetry of said slot also contains the point of juncture of two adjacent cavities, said wire fanning slots serving to route electrical conductors to a second one of said contacts (33) in a contact pair (31).

8. The sneak current protector module (10) in accordance with claim 1 wherein said mounting means (71) is comprised of electrically insulative material.

9. A sneak current protector module (10) comprising:

an insulative base (11) having a plurality of apertures (13) therein;

a plurality of slotted beam electrical contact pairs (31) mounted in said plurality of apertures in said base;

a plurality of fuse elements (51), each of said fuse elements having means (52,53) at opposite ends (55,56) thereof for effecting an electrical connection to electrically isolated contacts (33) in different ones of said contact pairs; characterized in that said sneak current protector module further includes insulative means (71), slidably affixed to said insulative base, for mounting said plurality of fuse elements along an edge (21) of said base, said mounting means comprising a generally elongated member (72) having a linear array of well-like cavities (73) therein, said cavities being used to hold said fuse elements;

a plurality of spaced-apart, generally L-shaped, hooklike members (74) extending laterally from said elongated member, each of said hooklike members having a first surface (75) which lies in a first plane parallel with a second plane containing axes of said well-like cavities and further having a second surface (76) which lies in a third plane generally perpendicular to said first and second planes, said first surface adapted for engagement with an inner surface (22) of said edge of said base and said second surface adapted for engagement with a top surface (23) of said edge of said base; and a plurality of spaced-apart, generally rectangular-shaped tabs (77) each of which extends laterally from said elongated member in the same direction as said hooklike members, each of said tabs having a surface (78) which is adapted for engagement with an outer surface (24) of said edge of said base, said tabs maintaining said elongated member in a planar relationship with said base.

10. The sneak current protector module (10) in accordance with claim 9 wherein said elongated member (72) further includes:

a plurality of slots (80), one such slot for each of said well-like cavities (73), each of said slots extending from a top edge of a cavity to a point adjacent to a bottom inner surface of said cavity, said slots providing an access way for an electrical conductor (52) coupling one end (55) of a fuse element (51) to a first one of said contacts (33) in a contact pair (31).

11. The sneak current protector module (10) in accordance with claim 9 wherein said elongated member (72) further includes:

a plurality of wire fanning slots (81), one such slot for each of said well-like cavities (73), each of said slots extending transversely of said elongated member and positioned such that a plane of symmetry of said slot also contains the point of juncture of two adjacent cavities, said wire fanning slots serving to route electrical conductors to a second one of said contacts (33) in a contact pair (31).

* * * * *